United States Patent [19]

Hoshika et al.

[11] Patent Number: 4,739,363

[45] Date of Patent: Apr. 19, 1988

[54] IMAGE FORMING APPARATUS

[75] Inventors: Norihisa Hoshika, Kawasaki; Hiroyuki Adachi, Hachiohji; Kimio Nakahata, Kawasaki, all of Japan

[73] Assignee: Canon Kabushiki Kaisha, Tokyo, Japan

[21] Appl. No.: 843,233

[22] Filed: Mar. 24, 1986

[30] Foreign Application Priority Data

Mar. 26, 1985 [JP] Japan ..... 60-61295
Jul. 4, 1985 [JP] Japan ..... 60-148106
Jul. 12, 1985 [JP] Japan ..... 60-152197

[51] Int. Cl.[4] ..... G03G 15/00

[52] U.S. Cl. ..... 355/3 CH; 355/3 TR; 355/14 CH; 361/214

[58] Field of Search ..... 355/3 CH, 3 TR, 14 CH; 361/225, 229, 235, 214

[56] References Cited

U.S. PATENT DOCUMENTS 3,744,898 7/1973 Kurahashi et al. ..... 355/3 CH
4,183,653 1/1980 Satomi et al. ..... 355/3 CH X
4,286,866 9/1981 Stelben et al. ..... 355/3 CH X
4,341,457 7/1982 Nakahata et al. ..... 355/3 CH
4,351,603 9/1982 Tagawa ..... 355/3 CH
4,449,808 5/1984 Abreu ..... 355/3 CH X
4,536,082 8/1985 Motohashi et al. ..... 355/14 TR
4,579,441 1/1986 Hart et al. ..... 361/214 X
4,607,937 8/1986 Minami ..... 355/14 CH
4,699,499 10/1987 Hoshika et al. ..... 355/3 CH

FOREIGN PATENT DOCUMENTS 0147985 7/1985 European Pat. Off. ..... 355/3 CH

*Primary Examiner*—A. T. Grimley
*Assistant Examiner*—Jane K. Lau
*Attorney, Agent, or Firm*—Fitzpatrick, Cella Harper & Scinto

[57] ABSTRACT

An image forming apparatus provided with an image transfer discharger for electrostatically transferring the toner image from an image bearing member to a transfer material. It is further provided with charge removing member for removing charge so as to allow the electrostatically attached transfer material from the image bearing member. The charge removing electrode is supplied with a bias voltage from a power source for the developing device, thus the additional means required for the charge removing electrode is minimized. The discharging electrode extends from a bottom of a recess formed by an insulating member. The recess is larger away from the free end of the discharging electrode toward the outside.

23 Claims, 4 Drawing Sheets

IMAGE FORMING APPARATUS

FIELD OF THE INVENTION AND RELATED ART

The present invention relates to an image forming apparatus such as an electrophotographic machine, more particularly, to an improvement in separation of a transfer material from an image bearing member, further particularly, to an image forming apparatus provided with a transfer material separating device for separating the transfer material from an image bearing member having a toner image which has been formed in accordance with a pattern of an electrostatic latent image and which is to be transferred to the transfer material.

In a widely used electrophotographic copying apparatus, a photosensitive member is passed by a charging station, an image exposure station, a developing station, an image transfer station and a transfer material separating station sequentially. By this, the surface of the photosensitive member is uniformly charged and then exposed to image light so that an electrostatic latent image is formed on the surface of the photosensitive member. The electrostatic latent image is visualized by charged developing toner particles. The visualized or developed image is transferred onto a transfer material, for example, a sheet of paper. In order to accomplish the image transfer, the transfer material is contacted to the photosensitive member carrying the toner image, while a corona discharge of a polarity opposite to the polarity of the toner particles is applied to the back surface of the transfer material, whereby the toner particles are transferred from the surface of the photosensitive member to the transfer material. After this image transfer, the transfer material is separated from the photosensitive member, and is conveyed to an image fixing device where the toner image now carried by the transfer material is fixed.

In this type of electrophotographic apparatus wherein the corona discharge is applied to the back surface of the transfer material so as to electrostatically transfer the toner image, electrostatic attraction is produced between the transfer material and the photosensitive member, with the result that they are strongly attached. Therefore, a transfer material separating means is required in order to separate the transfer material from the photosensitive member against the attraction force.

As conventional separating means, there is a mechanical means such as a separating pawl and a separating belt. However, those means involve a drawback that they can scrape a part of the image or damage the photosensitive member. As for another separating means, there are a type wherein air is blown and a type wherein the transfer material is sucked. However, those methods lead to bulky and complicated structures, and additionally, the toner can be scattered around within the apparatus.

As for a further method, a separation charger is disposed along a moving path of the photosensitive member and the transfer material so as to electrically discharge the transfer material from its back surface by the charge removing function of the separation charger, thus separating the transfer material from the photosensitive member electrostatically. In this method, the electrostatic attraction force between the photosensitive member and the transfer material is eliminated by nuetralization, and the transfer material is allowed to naturally separate from the photosensitive member by its weight and, the rigidity of the transfer material itself. This provides a relatively satisfactory separation as compared with the above-described mechanical separation. However, this method requires a high voltage electric power source for the separation, in addition to that for the toner image transfer operation, with the result of disadvantages in the bulkiness and the cost. Therefore, it is against the demand for reducing the size of the apparatus and reducing the cost.

In order to avoid the disadvantages in using the separation charger, Japanese patent application publications Nos. 152889/1979 and 1335979/1983 have made some proposals.

In the Japanese patent application publication No. 152889/1979, the corona discharging electrode for the image transfer and that for the transfer material separation are disposed within one and the same shield and electrically connected to one and the same AC power source. It is stated therein that the necessity of using an additional and separate power source is eliminated, whereby a small size and less costly separating device can be provided. However, this does not teach how high voltage is required to be applied to the electrode for the separation charger, so that it is not known whether the satisfactory separation function can be provided.

In the latter publication, that is, No. 133579/1984, it is proposed that the separating electrode is in the form of a blush and is spaced from the photosensitive member with a clearance of 0.76–1.27 mm, while −600−1000 V is applied to the discharging electrode. It is stated in this publication that such a high voltage power source as required in the case of the separation corona discharger is not required, and a small size and inexpensive DC source can be used, whereby the size of the device and the cost of the device can be reduced. However, since the clearance between the photosensitive member and the electrode blush is so small (0.76–1.27 mm) that it is practically impossible that the electrode blush is fixed without the possibility of the transfer material contacting it, in consideration of the possible waving of a thin transfer material and the small rigidity thereof. Under high humidity which results in a reduced resistance of the transfer material, the contact of the transfer material to the electrode blush, if it occurs, causes the toner particles to be scattered at the portion of the contact so that the image is void there.

When there is no transfer material at the transfer station due to an occurrence of jam or the like, the oppositely charged toner particles deposited on the photosensitive member in the background area are not transferred to a transfer material but are transferred to the electrode blush when the toner particles pass by the electrode blush to which a voltage of a polarity opposite to the toner. This is because the blush electrodes are very close to the photosensitive member and is electrically biased. The toner particles deposited to the electrode blush contaminates the back surface of the transfer material which is subsequently brought to the transfer station.

SUMMARY OF THE INVENTION

Accordingly, it is a principal object of the present invention to provide an image forming apparatus wherein the toner particles transferred to the transfer material are not scraped, and the image bearing member is not damaged.

It is another object of the present invention to provide an image formingi apparatus wherein the size and the cost of the transfer material separating device are reduced.

It is a further object of the present invention to provide an image forming apparatus wherein the occurrence of void in the transferred image can be avoided even under the condition of high humidity.

It is a further object of the present invention to provide an image forming apparatus wherein the back surface of the transfer material is not contaminated.

It is a further object of the present invention to provide an image forming apparatus provided with a transfer material separating device having a strong separating function.

It is a further object of the present invention to provide an image forming apparatus wherein the electric power source is efficiently utilized.

According to an embodiment of the present invention, the image forming apparatus includes a transfer material supporting device having means for forming an electric field to transfer the toner image formed on an image bearing member to a transfer material, a discharging electrode, disposed downstream of the transfer electric field forming means with respect to movement of the transfer material, for applying to the transfer material the electric discharge having a component of the polarity opposite to the transfer electric field, and an electric power source for applying to the discharging electrode a voltage not higher than the self-discharge starting voltage, the power source utilizing a bias voltage to a developing electrode.

In the embodiment, the electrode having a pointed tip as in a needle is preferable. Preferably, the voltage applied to the discharging electrode is set to be lower than the voltage with which self-discharging start. By this, during the image transfer operation, the electric discharge for the charge removal occurs, and therefore, no wastefull discharge occurs. By using the needle type of discharging electrode, the discharging efficiency of the charge removing electrode can be increased by increasing the space thereabove.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
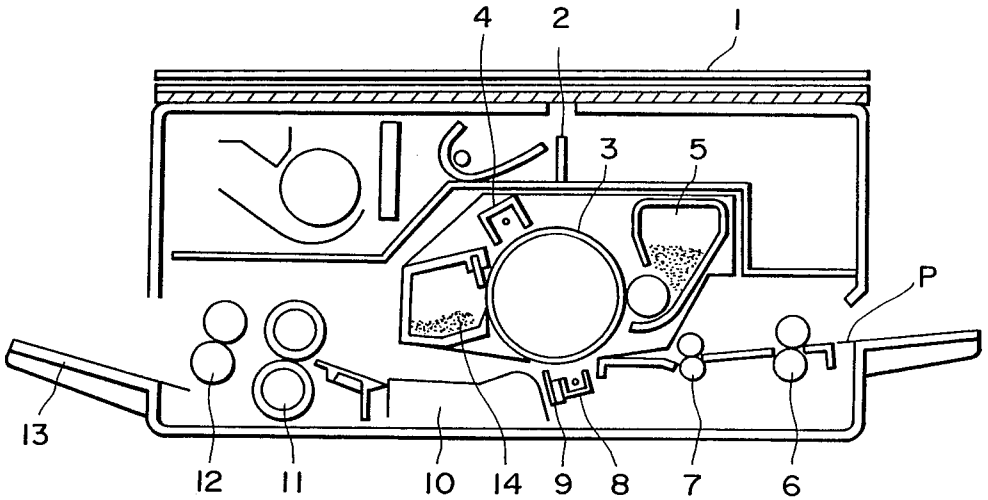
FIG. 1 is a sectional view of an electrophotographic apparatus provided with a transfer material separating device according to an embodiment of the present invention.

Referring now to FIG. 1, there is shown an electrophotographic copying apparatus for a personal use, provided with a transfer material separating device, according to an embodiment of the present invention. The apparatus includes an original carriage 1 having a transparent member reciprocally movable in a horizontal plane, a photosensitive member 3, and an array of short focus imaging elements for forming an image of an original placed on the original carriage 1 on the surface of the photosensitive member through a slit. The photosensitive member 3 is shown as being in the form of a drum, but it may be a web movable along an endless path. The apparatus further comprises an electric charger 4 for uniformly charging the photosensitive member 3.

Figure 4A:
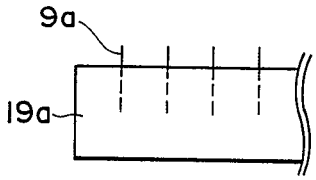
FIG. 4A is a front view of a part of an apparatus according to an embodiment of the present invention.
Figure 4B:
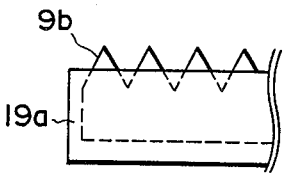
FIG. 4B is a front view of a part of an apparatus according to another embodiment of the present invention.

In operation, the photosensitive member 3 is first uniformly charged by the charger 4 and then is exposed to the image light through the array 2 of the imaging elements, so that an electrostatic latent image is formed on the photosensitive member. The electrostatic latent image thus formed is developed by a developing device 5 into a visualized image. On the other hand, a transfer material P in the form of a sheet of paper in this embodiment is fed to the photosensitive member 3 by a pick-up roller 6 and a registration roller couple 7 which is operated in association with the image on the photosensitive member 3 so as to align the transfer material with the image on the photosensitive member 3 at the transfer station, where the toner image on the photosensitive member 3 is transferred onto the transfer material P by a transfer charger 8 producing corona for the toner image transfer. Downstream of the transfer station with respect to movement of the transfer material P, there is provided a charge removing device 9 comprising an insulative block 19 and discharging electrodes 9*a* of conductive material mounted to the insulative block 19. The discharging electrodes 9*a* are in the form as shown in FIG. 4A or FIG. 4B which will be described hereinafter. By the charge removing device 9, the transfer material P is separated from the photosensitive member 3. The separated transfer material P is conveyed by a conveying belt 15 to an image fixing device 11, where the toner image is fixed on the transfer material P. The transfer material P is finally discharged to an external tray 13 by a discharging roller couple 12. In this embodiment, the photosensitive member 3, the charger 4, the developing device 5 and the cleaning device 14 are contained in a unit to constitute a process unit which is detachably mountable to the main frame of the image forming apparatus. By this unification, the maintenance operation is simplified, because the process unit as a whole can be replaced.

Figure 2:
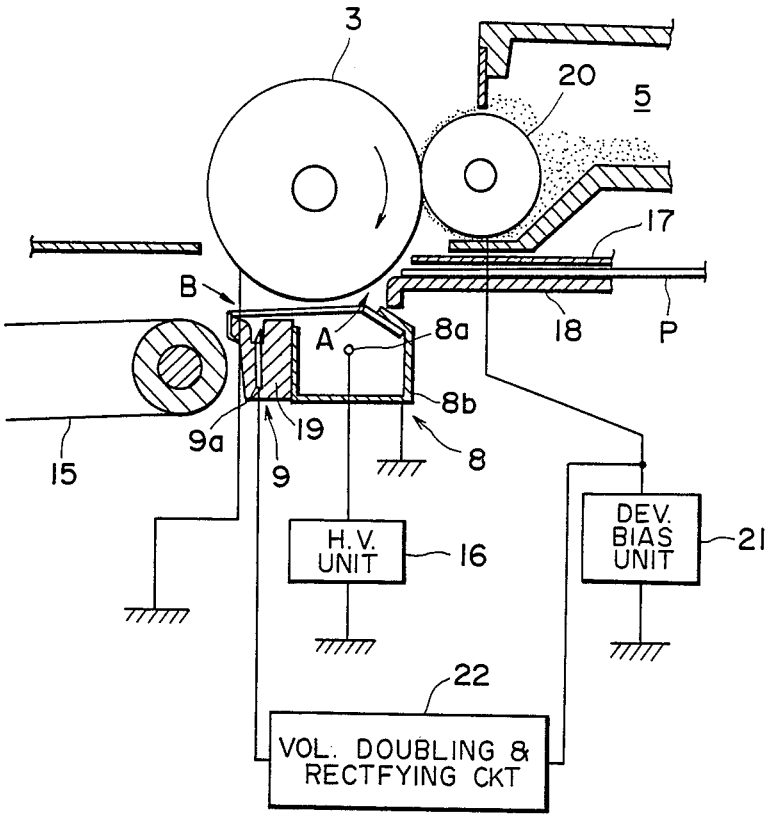
FIG. 2 is an enlarged sectional view of the separating device in the apparatus of FIG. 1.

FIG. 2 is an enlarged sectional view of the transfer material separating device in the electrophotographic apparatus of FIG. 1. The separating device will be described in further detail in conjunction with FIG. 2. It is assumed that an electrostatic latent image of negative polarity is formed on the photosensitive member 3, and the latent image is developed with toner particles positively charged, for the sake of explanation.

Between the photosensitive member 3 and a developing sleeve 20 of the developing device 5, a high voltage is applied so that an electric field is formed therebetween. Thus, the positively charged toner is transferred from the surface of the sleeve 20 to the photosensitive member 3. The high voltage may be AC or DC, or it may be provided by superimposing an AC with a DC, which is used in this embodiment.

The transfer material P is contacted to the photosensitive member 3 carrying the toner image in alignment with the toner image on the photosensitive member 3. The transfer material is conveyed to the transfer station between the upper transfer material guide 17 and the lower transfer material guide 18. The transfer material P passes by the transfer charger 8 while contacting to the photosensitive member 3.

The transfer charger 8 includes a transfer wire 8*a* stretched along the entire width of the photosensitive member 3 with a predetermined clearance thereform and a shield 8*b* enclosing the transfer wire 8*a*. To the transfer wire 8*a*, a negative DC voltage is applied by a transfer high voltage power source unit 16. The shield 8*b* is grounded and controls the amount of corona directing from the transfer wire 8*a* to the surface of the photosensitive member 3. The voltage applied to the transfer wire 8*a* is on-off controlled in a proper sequence determined with respect to the transferring operation.

When the transfer material P passes through the transfer position A while contacting to the photosensitive member 3, the negative high voltage is applied to the transfer wire 8*a* so as to produce negative corona directed to the surface of the photosensitive member 3, by which the toner image is transferred from the photosensitive drum 3 to the part of the transfer material P existing at the transferring position A.

To the discharging electrode 9*a*, a negative DC voltage is applied from the developing bias power source unit 21 through a voltage doubling and rectifying circuit 22, which is effective to doubling the voltage by adding the negative component to the positive component, so that the voltage applied to the electrodes 9*a* is approximately twice of the developing bias voltage. The application of the voltage to the discharging electrodes 9*a* is controlled with the same sequence as that of the developing bias, and therefore, the positive DC voltage is applied to the discharging electrodes 9*a* prior to the transfer material P receiving the corona from the transfer charger 8.

After the image is transferred, the transfer material P reaches the position B where the discharger 9 is provided. Since the positive high DC voltage is applied to the discharging electrodes 9*a* of the discharger or charge removing device 9 from the developing bias power source unit 21 through the voltage doubling and rectifying circuit 22, the charge on the transfer material P after the image tranfer is removed so that the electrostatic attraction force to the photosensitive member 3 removed. Then, the transfer material P is allowed to separate from the photosensitive member 3 surface by its weight and its rigidity.

The charge removing device 9 includes an insulative block 19 mounted to a downstream side, with respect to movement of the transfer material P, of the shield 8*b* of the transfer charger 8 and including the discharging electrode 9*a* mounted to the insulative block. It is preferable that the tips of the discharging electrodes 9*a* is not beyond the insulative block 19 in order to reduce the possibility of jam occurrence. The leading edge of the transfer material P thus separated from the photosensitive member 3 is received by a fishing line 23 stretched between the insulative block 19 and the transfer charger 8, and reaches the guide 10 (FIG. 1) or a conveying belt 15 (FIG. 2) without contacting the discharging electrode 9*a*.

In this embodiment, the transfer wire 8*a* is supplied with a voltage of approximately −5 KV with a stisfactory result of transfer operation.

The output of the developing bias power source unit 21 is a rectangular AC voltage (1600 Hz of the frequency and 1300 V of peak-to-peak voltage) superimposed with a DC voltage of −100−−450 V. The voltage applied to the discharging electrode 9*a* of the charge removing device 9 is supplied with +2.5 KV of a DC voltage through a doubling and rectifying circuit 22 from the developing bias source unit 21 which is also used for the developing bias. It has been confirmed that the good separating operation is performed with those figures. It is preferable that the clearance between the discharging electrodes 9*a* and the surface of the photosensitive member 3 is not less than 4 mm. When the clearance is 5 mm, the voltage at which the self discharge starts by the discharging electrode 9*a* without the application of the transfer voltage to the transfer wire 8*a* has been confirmed to be +4.5 KV. When the voltage applied to the discharging electrodes 9*a* is not more than 1.5 KV, a thin sheet having a less rigidity has not satisfactorily separated, particularly under the condition of low humidity. It has been confirmed that in order to provide a satisfactory separation under this condition, it has been found that at least +1.5 KV is required to be applied to the charge removing electrode 9*a*.

In the case of a "wet" paper which has been left under a high humidity condition, there occurs a void of a transfer image when a voltage not lower than 3 KV is applied to the discharger 9*a*. Therefore, when the clearance is approximately 5 mm between the photosensitive member 3 and the discharging electrodes 9*a*, the voltage applied to the charge removing needles 9*a* is preferably 2–3 KV.

According to this embodiment, the size and the cost of the entire electrophotographic apparatus can be reduced, and in addition, the void of the transfer image and the contamination of the back surface of the transfer material can be prevented, these conditions occurring particularly when the transfer material is thin, when the humidity is high or when the transfer operation occurs without the transfer paper, or under the like condition. Thus, the performance of the electrophotographic apparatus can be enhanced. Further, the charge removing efficiency can be increased by increasing the space between the discharging electrodes 9*a* and the transfer material P toward the transfer material, as shown in the Figures of this embodiment.

Figure 3:
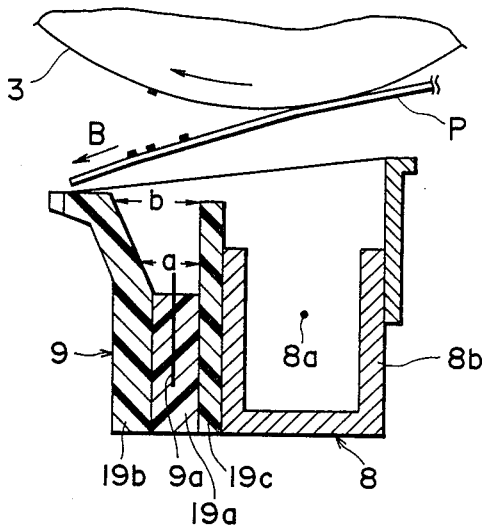
FIG. 3 is an enlarged sectional view of a major part of the apparatus according to another embodiment of the present invention.

FIG. 3 is an enlarged view of the transfer material separating position to explain this point. The separation charge removing device 9 is mounted to the downstream side of the transfer charger 8 with respect to advance of the transfer material P (arrow B).

The transfer charger 8 includes the charge wire 8a and a shield 8b of a conductive material enclosing the wire 8a.

The charge removing device 9 includes two insulative members 19c and 19a which are spaced as shown and extending in the direction perpendicular to the sheet of the drawing and includes an insulating member 19a disposed between the insulative member 19b and 19c. To the middle insulative member 19a, a number of discharging or charge removing needles 9a are planted with their tip ends exposed outside. As shown in this Figure, the top surfaces of the insulative members 19b and 19c are at higher levels than the shield 8b, that is, closer to the surface of the photosensitive member surface. Further, the clearance between the sandwiching insulative members 19b and 19c increases from the bottom toward the photosensitive member, that is, the clearance is enlarged from the width a to b. In other words, the clearance therebetween diverges toward the photosensitive member or toward the transfer material. Because of this diverging clearance, the member adjacent the discharging electrodes 9a are not electrically charged so as to allow continued good discharging operation. Therefore, the applied voltage for the separation can be decreased.

FIG. 4B shows another example of the discharging needles. In this example, a discharging or charge removing member 9b of conductive material is used which is formed into saw teeth having a number of pointed ends extended out of the insulative member 19a.

Figure 5:
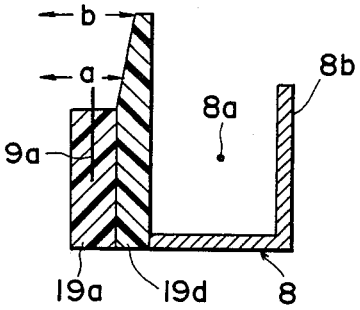
FIG. 5 is a sectional view of a major part of an apparatus according to a further embodiment of the present invention.

FIG. 5 shows a further example, wherein a part of the shield of the transfer charger is formed of insulating material at its side near the charge removing device 9, and the insulative member is commonly used as the insulative member for the charge removing device 9 and for the shield of the transfer charger.

Figure 6:
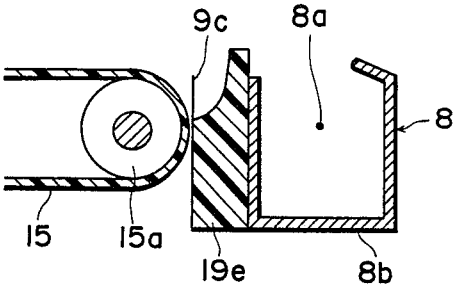
FIG. 6 is a sectional view of a major part of an apparatus according to a further embodiment of the present invention.

FIG. 6 illustrates a further embodiment of the present invention, wherein the transfer charger 8 has the similar structure as in FIG. 3 embodiment, that is, the insulative member 19e is mounted to the downstream side of the transfer charger, and the discharging needles 9c are fixed to one surface of the insulative member 19e.

Further downstream of the insulative member 19e, there is an insulative roller 15a and the conveying belt 10 of insulating material such as urethane rubber, which are closely adjacent to the discharging needles 9c. They are effective to convey the transfer material separated. It will be understood that the clearance diverging arrangement can be substantially obtained by this structure.

By enclosing the discharging electrode by the insulative member in such a manner that the space around the discharging electrodes increases away from the discharging electrodes, the discharging corona does not easily influence the transfer corona, and in addition, the tranfer material is prevented from contacting to the discharging electrodes. Furthermore, the diverging arrangement prevents from the portion of the member adjacent to the discharging electrodes from electrically charged to a high potential, by which the high charge removing efficiency can be maintained.

Figure 7:
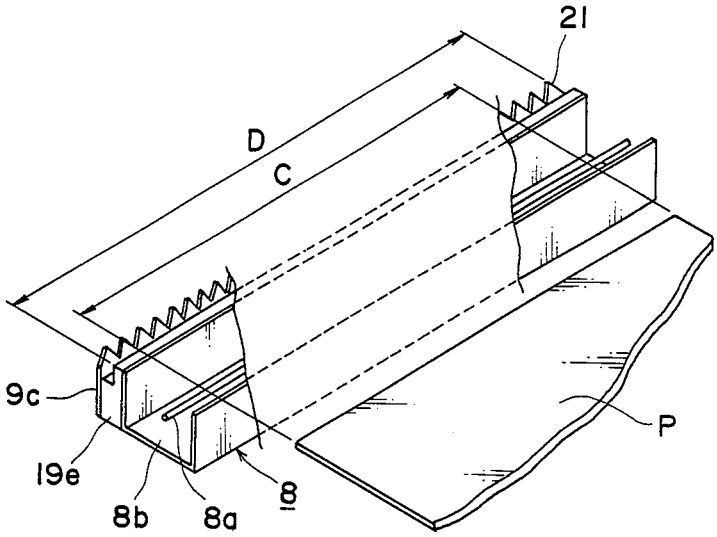
FIG. 7 is a perspective view illustrating the width of the discharging electrode and the width of the transfer material.
Figure 8:
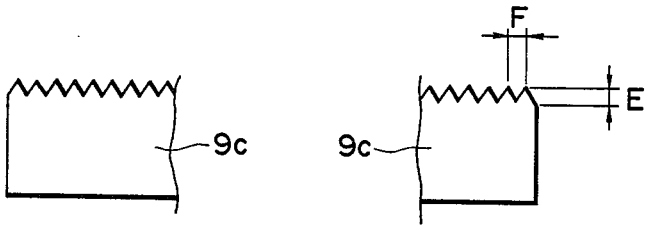
FIG. 8 is a front view of the discharging electrode usable with the present invention.

FIGS. 7 and 8 illustrate another embodiment of the present invention, wherein the configuration or arrangements of the charge removing needle is so defined that the separation efficiency is increased.

FIG. 7 illustrates the relationship between the width of the transfer material P having the usable maximum size and the width of the charge removing member 9c. In this embodiment, in order to make sure the prevention of the transfer paper P from contacting to the charge removing member 9c, there is provided a fishing line. In FIG. 7, the width of the transfer material P having the maximum size is indicated by "C", and the width of the discharging member or the width of the group of charge removing needles is indicated by "D". In this embodiment, the width is determined so that $C<D$ is satisfied as shown in FIG. 7. When a part of a lateral edge portions of the transfer material is not satisfactrily separated, the transfer paper the transfer paper can advance to the cleaning device or it is jammed even if the remaining portion is completed separated. By making the width of the discharge removing range of the charge removing means 9 larger than the width C of the transfer material, the transfer material is separated with certainty over the entire width thereof, thus providing a stable separation.

FIG. 8 shows an example of configuration of the discharging member 9c, wherein the height E of the needle or tooth is 3 mm, and the pitch F is 2 mm. By using the needles or pointed teeth, the discharge can easily occur so that the voltage to be applied may be decreased. The pitch F is not necessarily is 2 mm, but with the increase thereof, the charge removing operation becomes non-uniform along the width of the transfer material. From this standpoint, the pitch F is preferably not more than 30 mm, more preferably not less than 10 mm.

Figure 9:
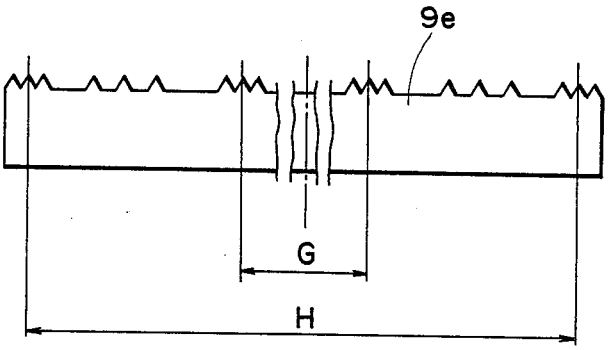
FIG. 9 is a front view of a discharging electrode usable with a further embodiment of the present invention.

FIG. 9 shows the configuration of the discharging needles according to a further embodiment. The transfer material paper used with the image forming apparatus has usually one of predetermined sizes, for example, A4 size or B4 size (Japanese Industrial Standard). Therefore, the position of the lateral ends are rather determined. Noting this, the pitch of the needles is decreased adjacent lateral end portions of the paper, and the pitch of the other part is larger, although smaller than the limit. This arrangement is effective to further assure the separation at one or both lateral ends of the transfer paper or material.

In FIG. 9, wherein a width indicated by "G" corresponds to A4 size, while a width "H" corresponds to B4 size. The pitches of the needles or teeth adjacent both of the lateral ends of those size sheets are decreased as compared with the other portion, so that the separation for the A4 size sheet and B4 size sheet are stabled.

As described in the foregoing, according to this embodiment of the present invention, the charge removing needles or teeth are disposed away from the image bearing member, and the width of the group of the discharging needles or teeth is larger than the width through which the transfer material passes. Therefore, the void of the image transfer, particularly under a high humidity condition, and the contamination of the back surface of the transfer material, can be prevented, thus providing satisfactorily assured separating operation.

Also in this case, the voltage applied to the charge removing needles or the charge removing member may be DC, AC or DC superposed with AC.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:
an image bearing member;
transferring means for electrostatically transferring a toner image formed on said image bearing member onto a transfer material;
a charge removing electrode disposed downstream of said transferring means with respect to movement of the transfer material; and
power source means for applying to said charge removing electrode a voltage not higher than a voltage with which a self discharge starts;
developing means for forming the toner image on said image bearing member; and
power source means for supplying a developing bias to said developing means, wherein said power source means for said charge removing electrode uses said power source means for said developing bias.

2. An apparatus according to claim 1, wherein said power source means for said electrode includes a rectifying circuit.

3. An apparatus according to claim 1, wherein said charge removing electrode has discharging portions.

4. An apparatus according to claim 3, wherein said discharging portions are each in a form of needle.

5. An apparatus according to claim 3, wherein said discharging portions are each in a form of a saw tooth.

6. An apparatus according to claim 1 or 3, wherein said charge removing electrode has a width larger than a maximum width of the transfer material usable with said apparatus.

7. An apparatus according to claim 1 or 3, further comprising an insulating member at least upstream of said charge removing electrode and which forms a wall adjacent said charge removing electrode, which wall defines a space which increases in width toward said image bearing member.

8. An apparatus according to claim 7, further comprising insulating transfer material conveying means which defines a wall downstream of said charge removing electrode.

9. An image forming apparatus, comprising:
an image bearing member;
transferring means for electrostatically transferring a toner image formed on said image bearing member onto a transfer material;
a charge removing electrode, disposed downstream of said transferring means with respect to movement of the transfer material, for removing charge from the transfer material using self-discharge; and
power source means for applying to said charge removing electrode a voltage not higher than a voltage with which the self-discharge starts;
an insulating member defining space in which said charge removing electrode is exposed, said space increasing in width toward the image bearing member.

10. An apparatus according to claim 9, wherein said insulating member forms walls downstream and upstream of said charge removing electrode.

11. An apparatus according to claim 10, further comprising transfer material conveying means for conveying a transfer material which is insulating, and the conveying means defines the downstream wall.

12. An apparatus according to claim 9, wherein said charge removing electrode has discharging portions.

13. An apparatus according to claim 12, wherein said discharging portions are each in a form of a needle.

14. An apparatus according to claim 12, wherein said discharging portions are each in a form of a saw tooth.

15. An apparatus according to claim 12, wherein said charge removing electrode has a width larger than a maximum width of the transfer material usable with said apparatus.

16. An apparatus according to claim 9, wherein the space expands in a downsteam direction with respect to the movement of the transfer material which is insulating.

17. An image forming apparatus, comprising:
an image bearing member;
transferring means for electrostatically transferring a toner image formed on said image bearing member onto a transfer material;
a charge removing electrode, disposed downstream of said transferring means with repsect to movement of the transfer material, for removing charge from the transfer material using self-discharge; and
power source means for applying to said charge removing electrode a voltage to higher than a voltage with which the self-discharge starts;
an insulating member defining a wall upstream of said charge removing means, said wall providing a surface, at a downstream side thereof, which is inclined to an upstream side in a direction toward the image bearing member.

18. An apparatus according to claim 17, further comprising transfer material conveying means for conveying the transfer material which is insulating, and the conveying means provides an additional downstream said charge removing electrode.

19. An apparatus according to claim 17, wherein said charge removing electrode has discharging portions.

20. An apparatus according to claim 19, wherein said discharging portions are each in a form of a needle.

21. An apparatus according to claim 19, wherein said discharging portions are each in a form of a saw tooth.

22. An apparatus according to claim 19, wherein said charge removing electrode has a width larger than a maximum width of the transfer material usable with said apparatus.

23. An apparatus according to claim 17, wherein the space expands toward downstream with respect to the movement of the transfer material which is insulating.

* * * * *

UNITED STATES PATENT AND TRADEMARK OFFICE

CERTIFICATE OF CORRECTION

PATENT NO. : 4,739,363 Sheet 1 of 2

DATED : April 19, 1988

INVENTOR(S) : NORIHISA HOSHIKA, ET AL.

It is certified that error appears in the above-identified patent and that said Letters Patent is hereby corrected as shown below:

Column 2, line 3, "and," should read --and--;

line 58, "toner" should read --toner is applied--;

line 61, "contaminates" should read --contaminate--.

Column 3, line 4, "formingi" should read --forming--;

line 38, "start" should read --starts--.

Column 5, line 47, "to" should read --in--.

Column 6, line 6, "is" should read --are--;

lines 16-17, "stisfactory" should read --satisfactory--

Column 7, line 23, "member" should read --members--;

line 61, "prevents from" should read --prevents--;

line 62, "from" should read --from being--.

UNITED STATES PATENT AND TRADEMARK OFFICE

CERTIFICATE OF CORRECTION

PATENT NO. : 4,739,363 Sheet 2 of 2

DATED : April 19, 1988

INVENTOR(S) : NORIHISA HOSHIKA, ET AL.

It is certified that error appears in the above-identified patent and that said Letters Patent is hereby corrected as shown below:

Column 8, line 13, "portions" should read --portion--;

line 14, "the transfer paper the transfer paper" should read --the transfer paper--;

line 27, "is 2 mm," should read --2 mm,--;

line 48, ". The" should read --, the--.

Column 9, line 28, "of needle" should read --of a needle--.

Signed and Sealed this

Twenty-third Day of August, 1988

*Attest:*

DONALD J. QUIGG

*Attesting Officer*

*Commissioner of Patents and Trademarks*